United States Patent [19]

Kohri et al.

[11] Patent Number: 4,990,427

[45] Date of Patent: Feb. 5, 1991

[54] TONER FOR DEVELOPING ELECTROSTATIC LATENT IMAGES

[75] Inventors: Toshitaro Kohri, Higashiosaka; Hitoshi Kato, Itami; Kunio Takahashi, Itami; Junji Machida, Itami, all of Japan

[73] Assignee: Minolta Camera Kabushiki Kaisha, Osaka, Japan

[21] Appl. No.: 747,377

[22] Filed: Jun. 21, 1985

Related U.S. Application Data

[63] Continuation of Ser. No. 598,454, Apr. 9, 1984, abandoned.

[30] Foreign Application Priority Data

Apr. 8, 1983 [JP] Japan ..... 58-62459
Apr. 9, 1983 [JP] Japan ..... 58-62573

[51] Int. Cl.[5] ..... G03G 9/08
[52] U.S. Cl. ..... 430/110; 430/106
[58] Field of Search ..... 430/110, 106

[56] References Cited

U.S. PATENT DOCUMENTS 3,246,148 4/1966 De Troeyer et al. ..... 430/126
3,392,139 7/1968 Dingman ..... 430/106
3,547,822 12/1970 Miller ..... 430/106.6
3,885,960 5/1975 Anderson ..... 430/118
3,965,023 6/1976 Vijayendran ..... 430/137
4,347,298 8/1982 Kroll et al. ..... 430/106.6 X
4,476,211 10/1984 Hosoi ..... 430/137

FOREIGN PATENT DOCUMENTS 115159 3/1982 Japan .

OTHER PUBLICATIONS

Japanese Laid-Open Patent Application No. 55-90509 (Jul. 9, 1980).
Japanese Laid-Open Patent Application No. 57-40259 (Mar. 5, 1982).

*Primary Examiner*—J. David Welsh
*Attorney, Agent, or Firm*—Wenderoth, Lind & Ponack

[57] ABSTRACT

The invention relates to a toner for developing electrostatic latent images for use in copying machines and including a thermoplastic resin and a black coloring material as main components. The black coloring material comprises a substantially non-magnetic inorganic black pigment of 5–25 cc/100 g oil absorption and 0.5–10 μm average particle diameter, to obtain high quality copy images having fine textures.

4 Claims, No Drawings

TONER FOR DEVELOPING ELECTROSTATIC LATENT IMAGES

This application is a continuation of now abandoned application Ser. No. 598,454, filed Apr. 9, 1984 now abandoned.

BACKGROUND OF THE INVENTION

The present invention relates to a toner for developing electrostatic latent images including a thermoplastic resin and a black coloring material as main components and suited for use in a copying machine, in particular a copying machine comprising an oilless type, heated roller fixing device.

The oilless type heated roller fixing device herein referred to means the type of fixing device that comprises a pair of rollers, i.e. a silicone rubber roller and a heated roller of téflon-coated stainless steel, and has toner images present on copy paper thermally fixed thereon as the latter is passed between the pair of rollers.

As the black coloring material in the toner, it has been conventional practice to use magnetic powder such as of magnetic iron oxide or non-magnetic carbon black.

However, for obtaining a sufficient coloring only by means of magnetic powder, a magnetic powder content of 10 percent by weight or more is necessary. In ordinary magnetic brush development, the toner containing the above amount of magnetic powder, because of its own magnetism, undergoes a strong magnetic constraining force of a magnet roll, which tends to deteriorate transfer of the toner onto a photosensitive material (i.e. development) and lower a developed image density.

On the other hand, use of carbon black has advantages that there occurs no reduction of image density in magnetic brush development since carbon black is non-magnetic, that sufficient coloring is obtained with a relatively small amount, and that the tribo-electric charge of the toner is adjustable by varying the carbon black content. Therefore, carbon black has heretofore been in extensive use as the black coloring material.

However, the use of carbon black has the following disadvantage which is apparent particularly when toner images are fixed by the oil-less, type heated roller fixing device, and improvement has been desired.

The disadvantage is that, when images are fixed by the oil-less type heated roller fixing device, toner particles transferred onto copy paper in advance become unevenly distributed as they cool off after thermal fusion, which is particularly noticeable at so-called half-tone image portions having about a 0.8 density, and which results in roughness in the texture of fixed images.

SUMMARY OF THE INVENTION

The present invention intends to overcome the disadvantage of the prior art. The inventors have carried out researches on the cause of the roughness in the texture of fixed images and arrived at the following findings:

The thermoplastic resin in the toner suited for thermal fixation has a high viscosity, and because of the high viscosity fused resin contracts itself upon cooling, causing the toner particles to aggregate thereby to distribute the toner unevenly to the detriment of developed image quality. Moreover, carbon black is not only ineffective to check the aggregation but tends to promote it.

An object of the present invention, in one aspect, is to provide a toner for which a substantially non-magnetic special material is used as the black coloring material, such a toner permitting clearly defined, high-quality images to be fixed by the oillness type heated roller fixing device while avoiding low density development of images.

A further aspect of the present invention has for an object to provide a toner capable of producing the foregoing effect while retaining the advantage derived from the use of carbon black.

In order to achieve the first mentioned object, a toner for developing electrostatic latent images according to one aspect of the present invention has a basic characteristic feature in a black coloring material comprising substantially a non-magnetic inorganic black pigment having a 5–25 cc/100 g oil absorption and a 0.5–10 μm average particle diameter.

The use of the inorganic black pigment as described above produces a sufficient coloring while avoiding reduction in the density of developed images. Moreover, the inorganic black pigment having a smaller oil absorption than the 60–70 cc/100 g oil absorption of carbon black, is free from the thermoplastic resin contracting itself and prevents the toner particles from getting unevenly distributed at fixing times. Thus, resulting fixed images are clearly defined and of high quality.

In order to achieve the object of the present invention, according to the further aspect as noted above, a toner is characterized by containing a black coloring material comprising cupric oxide (CuO) of 0.5–10 μm average particle diameter in a proportion of 1-30 weight parts to 100 weight parts of a thermoplastic resin, and carbon black in a proportion of 1/15–1 in weight of the cupric oxide (CuO).

According to the further aspect of the invention, cupric oxide (CuO) having about 15 cc/100 g oil absorption is utilized as the inorganic black pigment described in relation to said one aspect of the invention. The use of cupric oxide (CuO) produces the same effect as in said one aspect. Moreover, the black coloring material according to the further aspect, by retaining carbon black as a component and making full use of the advantage thereof, permits the carbon black to adjust the tribo-electric charge of the toner.

Particularly, since cupric oxide (CuO) is used as the inorganic black pigment, a small amount thereof is effective to provide a fine texture for fixed images. Besides, the black coloring material containing cupric oxide (CuO) permits excellent fixation compared with the prior art material utilizing carbon black only, in that images are fixed very solidly or the fixing temperature may be 5°–10° C. lower at times of thermal fixing, for attaining fixation with a solidity equal to the case of the prior art. This facilitates selection of materials for forming the fixing device also.

Particularly when a type is used to apply silicone oil to the heated roller at times of fixation, the entire copying machine has to be large and costly because an oil applicator device is incorporated thereinto, and this involves troublesome maintenance including an oil changing step. In recent years, therefore, the oilless type heated roller fixing device is increasingly favored. The present invention has a great utility from the point of view of application since the fixing device, whether an oil applying type or an oilless type is used, provides high-quality fixed images.

It is to be noted that the thermoplastic resin used in the toner for developing electrostatic latent images according to the present invention may be selected, for example, from styrene-acrylic copolymer resin, polyester resin, methacrylic resin, and varied derivatives thereof.

Furthermore, the substantially non-magnetic inorganic black pigment may comprise, apart from cupric oxide (CuO) as already noted, for example, thallium sequioxide ($Tl_2O_3$), chromous oxide (CrO), stannous oxide (SnO), titanium monoxide (TiO), manganese oxide ($Mn_2O_3$;$MnO_2.H_2O$;$Mn_3O_4$), calcium boride ($CaB_6$), chromium sulfide (CrS), iron sulfide (FeS;-$Fe_2S_3$), copper sulfide ($Cu_2S$;CuS) molybdenum sulfide ($MoS_2$), graphite (C), lead sulfide (PbS), or a mixture thereof. However, the range of selection is of course not limited to the above substances.

Furthermore, in addition to the thermoplastic resin and black coloring material, the toner according to this invention may contain, as necessary, a chromium complexed solvent dye or nigrosine type solvent dye as an electric charge controller.

DESCRIPTION OF THE PREFERRED EMBODIMENTS

The invention is hereinafter described with reference to the EXAMPLES, the COMPARATIVE EXAMPLES and the COMPARATIVE EXPERIMENTS.

EXAMPLE 1

100 weight parts of styrene acrylic copolymer resin with a, molecular weight Mn:8200, Mw:182000, and a glass transition point Tg:59° C.; 4 weight parts of a chromium complexed solvent dye BONTRON S-34 (manufactured by Orient Chemical Industries, Ltd., Japan); 5 weight parts of carbon black MA #8 (manufactured by Mitsubishi Chemical Industries, Ltd., Japan); 6 weight parts of cupric oxide (CuO) (manufactured by Wako Purechemical Industries, Ltd., Japan), oil absorption: 15 cc/100 g, average particle diameter: 4.0 μm; and 3 weight parts of low molecular weight polypropyrene VISCOL 330P (manufactured by Sanyo Chemical Industries, Ltd., Japan) were added together.

The above components were sufficiently crushed and mixed in a ball mill, and are then kneaded by a three-roll mill. The resulting product was allowed to cool, and was thereafter crushed to fine particles by a jet mill and classified by a high speed rotor classifier to finally obtain a toner having a 12.0 μm average particle diameter (hereinafter called Toner A).

EXAMPLE 2

100 weight parts of a styrene-acrylic copolymer resin with a molecular weight Mn:9500, Mw:195000, and a glass transition point Tg:58° C.; 4 weight parts of nigrosine type solvent dye BONTRON N-06 (manufactured by Orient Chemical Industries, Ltd., Japan); 3 weight parts of carbon black MA #44 (Manufactured by Mitsubishi Chemical Industries, Ltd., Japan); 6 weight parts of cupric oxide (CuO), as in EXAMPLE 1; and 4 weight parts of low molecular weight polypropyrene VISCOL 330P were added together.

The above components were treated in the same manner as in EXAMPLE 1 to obtain a toner having a 12.5 μm average particle diameter (hereinafter called Toner B).

EXAMPLE 3

100 weight parts of a polyester resin, with a molecular weight Mn:6500, Mw:158000, and a glass transition point Tg:65° C.; 2 weight parts of a chromium complexed solvent dye BONTRON S-34; 5 weight parts of carbon black MA #100 (manufactured by MItsubishi Chemical Industries, Ltd., Japan); 9 weight parts of cupric oxide (CuO), as in EXAMPLE 1; and 3 weight parts of polyethlene oxide SAN WAX E-300 (manufactured by Sanyo Chemical Industries, Ltd., Japan) were added together.

The above components were treated in the same manner as in EXAMPLE 1 to obtain a toner having a 12.5 μm average particle diamter (hereinafter called Toner C).

EXAMPLE 4

Of the components in EXAMPLE 1, the 6 weight parts of cupric oxide (CuO) was replaced with 6 weight parts of molybdenum sulfide ($MoS_2$) (Manufactured by Dow Corning Co., Ltd.), oil absorption: 24cc/100 g, average particle diameter: 4.2 μm. The components were treated in the same manner as in EXAMPLE 1 to obtain a toner having a 13.0 μm average particle diamter (hereinafter called Toner D).

EXAMPLE 5

Of the components in EXAMPLE 1, the weight parts of cupric oxide (CuO) was replaced with 6 weight parts of manganese dioxide ($MnO_2.H_2O$) (manufactured by Wako Purechemical Industries, Ltd.), oil absorption; 23 cc/100 g, average particle diameter: 6.5 μm. The components were treated in the same manner as in EXAMPLE 1 to obtain a toner having a 12.5 μm average particle diamter (hereinafter called Toner E).

EXAMPLE 6

Of the components in EXAMPLE 3, the 9 weight parts of cupric oxide (CuO) was replaced with 9 weight parts of lead sulfide (PbS) (manufactured by Wako Purechemical Industries, Ltd.), oil absorption: 20 cc/100 g, average particle diameter: 8 μm. The components were treated in the same manner to obtain a toner having a 13.5 μm average particle diameter (hereinafter called Toner F).

COMPARATIVE EXAMPLE 1

The components in EXAMPLE 1, excluding cupric oxide (CuO), were treated in the same manner to obtain a toner having a 12.5 μm average particle diameter (hereinafter called Toner G).

COMPARATIVE EXAMPLE 2

The components in EXAMPLE 2, excluding cupric oxide (CuO), were treated in the same manner to obtain a toner having a 12.5 μm average particle diameter (hereinafter called Toner H).

COMPARATIVE EXAMPLE 3

The components in EXAMPLE 3, excluding cupric oxide (CuO), were treated in the same manner to obtain a toner having a 12.0 μm average particle diameter (hereinafter called Toner I).

COMPARATIVE EXAMPLE 4

Of the components in EXAMPLE 2, the 6 weight parts of cupric oxide (CuO) was replaced with 6 weight parts of triiron tetroxide ($Fe_3O_4$) BC-20(manufactured by Toyo Pigment Industries, Ltd., Japan), oil absorption: 34 cc/100 g, average particle diameter: 3.2 μm. The components were treated in the same manner to obtain a toner having a 13.0 μm average particle diameter (hereinafter called Toner J).

COMPARATIVE EXAMPLE 5

Of the components in EXAMPLE 2, the 6 weight parts of cupric oxide (CuO) was replaced with 6 weight parts of graphite (C) (manufactured by Wako Pure-chemical Industries, Ltd.), oil absorption: 65 cc/100 g, average particle diameter: 6.9 μm. The components were treated in the same manner to obtain a toner having a 12.5 μm average particle diameter (hereinafter called Toner K).

EXAMPLE FOR REFERENCE

The 6 weight parts of cupric oxide (CuO) in EXAMPLE 1 was reduced to 3 weight parts, and the components were treated in the same manner to obtain a toner having a 12.5 μm average particle diameter (hereinafter called Toner L).

Each of Toners A to L above was evenly mixed with 0.2 percent by weight of colloidal silica AEROSIL R -972 (manufactured by Aerosil Nippon Co., Ltd., Japan) and, after the above treatment, was mixed with (a magnetic carrier obtained by a process to be described later), to obtain two-component magnetic developing materials showing an equal or similar tribo-electric charge (which are referenced A to L as are the toners).

The magnetic carrier preparing process is described first. 100 weight parts of styrene-Acrylic copolymer resin PLIOLITE ACL (manufactured by Goodyear International Corp.), 200 weight parts of magnetic powder MAPICO BLACK BL-500 (manufactured by Titanium Industries, Ltd.), and 5 weight parts of carbon black MA#100 were sufficiently mixed and crushed by a ball mill, and were then sufficiently thermally fused and kneaded by a three-roll mill. The resulting mixture was fine-crushed by a jet mill and classified by a classifier to obtain a magnetic carrier having a 23 μm average particle diameter.

The described two-component developing materials A-L, respectively, have toner mixing ratios [={toner/(carrier+toner)}×100 wt %] and initial tribo-electric charges as shown in Table 1.

TABLE 1

| Developing material | Mixing ratio (% by weight) | Electric charge (μc/g) |
|---|---|---|
| A | 8 | −14 |
| B | 10 | +15 |
| C | 9 | −14 |
| D | 8 | −12 |
| E | 8 | −13 |
| F | 9 | −15 |
| G | 8 | −15 |
| H | 10 | +15 |
| I | 9 | −14 |
| J | 10 | +13 |
| K | 10 | +13 |
| L | 8 | −14 |

Photocopying tests were carried out on the developing materials A-L prepared as above, by using a copying machine I employing a positive charge type Se photoreceptor and a copying machine II employing a negative charge type CdS binder photoreceptor, to observe textures at halftone portions, tone reproductivity and line reproductivity. The results are shown in Table 2.

Each of the copying machines I and II were comprised of a developing device and fixing device, the developing device including a developing sleeve opposed to the photoreceptor and housing a magnet roller driven at high speed, and a bucket roller to stir the developing material and tribo-electrically charge the toner with the carrier and to supply the developing material to the developing sleeve, and the fixing device being a heated roller fixing device including a pair of rollers, i.e. a so-called oilless type, teflon-coated stainless steel heated roller and a silicone rubber roller, to fix toner images transferred to copy paper after the development stage. The copying speed was 25 sheets of A4 size copy paper per minute.

The textures at halftone portions were observed with the eye. Tone reproductivity was evaluated by using Gray Scale 20-step Q-13 of Kodak, and line reproductivity by using Chart AR-4 of Data Quest.

TABLE 2

| Developing material | Texture | Tone reproductivity (steps) | Line reproductivity (number of lines/mm) |
|---|---|---|---|
| A | ⊙ | 8 | 8.O |
| B | ⊙ | 10 | 9.0 |
| C | ⊙ | 11 | 9.0 |
| D | ○ | 7 | 7.1 |
| E | ○ | 8 | 7.1 |
| F | ○ | 7 | 7.1 |
| G | X | 5 | 5.6 |
| H | X | 6 | 5.6 |
| I | X | 6 | 5.6 |
| J | Δ | 8 | 6.3 |
| K | X | 8 | 5.6 |
| L | Δ | 7 | 6.3 |

Judgment on texture:
⊙ very fine
○ nearly fine
Δ a little rough
X very rough

Judgment on tone reproductivity: Each of the copying machines was operated to reproduce images at the second step in the Gray Scale, and those at the seventh step or above may be said excellent.

Judgment on line reproductivity: 6/mm or more may be said excellent.

The foregoing results show that Toners A to F according to the present invention are excellent in respect to texture as well as tone reproductivity and line reproductivity. The inclusion of cupric oxide (CuO) as a component was found to produce particularly good results.

Durability tests were also conducted on the above developing materials, by repeating photocopying over a long period of time. The materials A-I, K and L showed a durability for 60,000 sheets but the material J tended to produce low density images. It is considered an influence of the magnetic constraining force noted hereinbefore.

Further, the foregoing evaluation was made of the inorganic black pigment, by varying its oil absorption. An oil absorption exceeding 25 cc/100 g resulted in rough texture (Toner K) and, for practical purposes, a desired fine texture was found to be obtainable from the range of 5–25 cc/100 g.

It is to be noted that the above oil absorption greatly varies with the kind of pigment. Even with the same kind of pigment, minor variations occur depending, for example, on the surfacial state or area, and the nature such as the shape (crystallized state) and the like of the pigment.

For example, the smaller the particle diameter, the greater is oil absorption, and cubic crystals have a small oil absorption whereas needle-like crystals have a great oil absorption.

In the present invention, the oil absorption was measured by the following method. First, the pigment is accurately measured and then linseed oil (a reagent manufactured by Wako Purechemical Industries, Ltd.) in a 10cc burette (with minimum division at 0.05 cc) is dripped therefrom by drops of 0.05 cc to wet the pigment in the watch glass and turn it into a paste. At this time, an end point is marked by a glaze of pigment produced by a drop (0.05 cc) and drippings up to that point were regarded as oil absorption.

The oil absorption of carbon black measured by the above method is shown below for the sake of reference.

MA #8 (manufactured by Mitsubishi Chemical Industries, Ltd.) 68 cc/100 g

PRINTEX 25 (manufactured by Degussa Japan) 60 cc/100 g

SPECIAL BLACK 250 (same as above) 64 cc/100 g

Further, variation in the average particle diameter of the inorganic black pigment showed that average diameters below 0.5 μm would produce rough texture and those exceeding 10 μm which was greater than the particle diameter of the toner would cause flaws on the photoreceptor owing to the pigment separated from the toner. Therefore, the range of 0.5–10 μm is desirable.

Variation was also made in the inorganic black pigment content relative to 100 weight parts of thermoplastic resin, and in the ratio of the inorganic black pigment relative to carbon black where carbon black is used as the black pigment. In the former case the content below 1 weight part had no effect on the texture and the content exceeding 30 weight parts would cause flaws on the photoreceptor owing to the separated pigment. It is therefore desirable to have the black pigment content in the range of 1–30 weight parts, preferably 2–10 weight parts from the safety point of view considering use of a photoreceptor having a soft surface, and the range of 5–9 weight parts is particularly suited for practical purposes. In the latter case the carbon black content in a ratio greater than the black pigment would deteriorate the texture as seen from the EXAMPLE FOR REFERENCE (Toner L) and conversely the carbon black content less than 1/30 of the black pigment content would jeopardize electric charge adjustment and qualities of developed images. Thus it has been found that the range of 1/30–1, preferably 1/20–1, is suited.

The foregoing is hereinafter supplementally explained by means of specific examples, comparative examples and comparative test results.

EXAMPLE 7

100 weight parts of a styrene-acrylic copolymer resin, with a molecular weight Mn:95000, Mw:195000, and a glass transition point Tg:58° C.; 2 weight parts of cromium complexed solvent dye. BONTRON S-34; 5 weight parts of carbon black MA #8; and 5 weight parts of cupric oxide (CuO), the same as in EXAMPLE 1; and 2.5 weight parts of low molecular weight polypropyrene VISCOL 330P added thereto.

The above components were mixed well in a super mixer, kneaded in a twin screw extruder and were then cooled and crushed to coarse particles. Thereafter the course particles are fine crushed by a jet mill and classified by a high speed rotor classifier to obtain a toner having a 12.5 μm average particle diameter (hereinafter called Toner M).

EXAMPLE 8

Of the components in EXAMPLE 7, the 100 weight parts of thermoplastic styrene-acrylic copolymer resin were replaced with 100 weight parts of thermoplastic polyester resin, having a molecular weight Mn: 6500, Mw: 200000, and a glass transition point Tg: 66° C. The components were treated in the same manner to obtain a toner having a 12.5 μm average particle diameter (hereinafter called Toner N).

EXAMPLE 9

100 weight parts of thermoplastic styrene-acrylate resin, same molecular weight and glass transition point as in EXAMPLE 8; 5 weight parts of nigrosine type solvent dye NIGROSINE BASE EX (manufactured by Orient Chemical Industries, Ltd.); 3.5 weight parts of carbon black MA #8; and 7 weight parts of cupric oxide (CuO) were mixed together, as in EXAMPLE 1; and 2.5 weight parts of low molecular weight polypropyrene VISCOL 330P was added thereto.

The above components were treated in the same manner as in EXAMPLE 7 to obtain a toner having a 13.7 μm average particle diameter (hereinafter called Toner O).

COMPARATIVE EXAMPLE 6

Of the components in EXAMPLE 7, the carbon black content relative to the 100 weight parts of thermoplastic resin was varied from 0.8 to 5 weight parts, and the cupric oxide (CuO) content relative to the 100 weight parts of thermoplastic resin was varied from 0 to 36 weight parts. The components were treated in the same manner as in EXAMPLE 7 to obtain toners shown in Table 3.

TABLE 3

| Toner | P1 | P2 | P3 | P4 | P5 | P6 | P7 | P8 | P9 | P10 | P11 |
|---|---|---|---|---|---|---|---|---|---|---|---|
| Carbon black | 0.8 | 1 | 2 | 2 | 3 | 3 | 5 | 5 | 5 | 5 | 5 |
| Cupric oxide (CuO) | 0.8 | 1 | 30 | 36 | 3 | 30 | 3 | 10 | 30 | 35 | 0 |
| Weight ratio of CuO relative to carbon black | 1.0 | 1.0 | 15 | 18 | 1.0 | 10 | 0.6 | 2.0 | 6.0 | 7.0 | 0 |

COMPARATIVE EXAMPLE 7

Of the components in EXAMPLE 7 the average particle diameter of cupric oxide (CuO) was varied from 0.3–18 μm, and the components were treated in the same manner as in EXAMPLE 7 to obtain toners shown in Table 4.

TABLE 4

| Toner | Q1 | Q2 | Q3 | Q4 | Q5 |
|---|---|---|---|---|---|
| Particle diameter of CuO (μm) | 0.3 | 0.5 | 1 | 10 | 18 |

COMPARATIVE EXAMPLE 8

The components in EXAMPLES 8 and 9, excluding cupric oxide (CuO), were treated in the same manner to obtain Toners R and S, respectively.

Each of Toners M to S above was evenly mixed with 0.2 percent by weight of colloidal silica AEROSIL R972 and, after the above treatment, was mixed with a magnetic carrier having a 40 μm average particle diameter obtained by the already described method (toner mixing ratio: 10 percent by weight), to obtain a two-component magnetic developing materials (referenced M to S as are the toners).

Photocopying tests were carried out on the developing materials M, N, P1–P11, Q1–Q4 and R with the aforesaid copying machine I and on the developing materials O, Q5 and S with the copying machine II to observe textures at halftone portions, developed image density (I. D.) and presence of flaws on photoreceptor surfaces. The results are shown in Table 5.

The halftone portions were evaluated by the same criteria as for the data in Table 2. The flaws on the photoreceptor surface were observed with the eye after processing 60,000 sheets of copy paper. The image density was measured by using a reflecting density meter.

TABLE 5

| Developing material | Texture | I.D. | Flaws |
|---|---|---|---|
| M | ○ | 1.2 or more | ⊙ |
| N | ○ | " | ⊙ |
| O | ⊙ | " | ⊙ |
| P1 | X | O.8 | ⊙ |
| P2 | ○ | 1.0 | ⊙ |
| P3 | ⊙ | 1.2 or more | ○ |
| P4 | ⊙ | " | X |
| P5 | ○ | " | ⊙ |
| P6 | ⊙ | " | ○ |
| P7 | X~Δ | " | ⊙ |
| P8 | ⊙ | " | ⊙ |
| P9 | ⊙ | " | ○ |
| P10 | ⊙ | " | X |
| P11 | X | " | ○ |
| Q1 | X | " | ⊙ |
| Q2 | Δ~○ | " | ⊙ |
| Q3 | ○ | " | ⊙ |
| Q4 | ⊙ | " | ○ |
| Q5 | ⊙ | " | X |
| R | X | " | ⊙ |
| S | X | " | ⊙ |

Judgment of flaws
⊙ no flaws
○ almost no flaws
X flaws detected

Judgment on image density: Those at 1.0 or above may be said excellent.

The results in Table 5 show that the greater the cupric oxide (CuO) content the better is the texture, conversely, where carbon black is utilized as the black pigment, the greater the carbon black content the worse is the texture, and the greater weight ratio of cupric oxide (CuO) relative to carbon black the better is the texture. Furthermore, the tests have revealed the following facts:

(1) Good results are obtained from 1–30 weight parts of cupric oxide (CuO) relative to 100 weight parts of thermoplastic resin. Less than 1 weight part of cupric oxide (CuO) as in the developing materials P1, P11, R and S resulted in unsatisfactory textures whereas its content exceeding 30 weight parts as in the developing materials P4 and P10 caused flaws on the photoreceptor.

(2) Good results are obtained from cupric oxide (CuO) having 0.5–10 μm average particle diameters. An average particle diameter less than 0.5 μm as in the developing material Q1 resulted in an unsatisfactory texture whereas one exceeding 10 μm as in the developing material Q5 caused flaws on the photoreceptor.

(3) Good results are obtained from the weight ratio of carbon black relative to cupric oxide (CuO) in the range of 1/30–1, preferably 1/15–1, where carbon black is utilized as the black pigment. The weight ratio exceeding 1 as in the developing materials P7, P11, R and S resulted in unsatisfactory textures whereas the ratio less than 1/15, particularly less than 1/30, as in the developing material P4 would jeopardize electric charge adjustment because of lack in the amount of carbon black and hence impracticable in one aspect.

Furthermore, fixing temperatures (temperatures of the teflon-coated heated roller surface that contacts toners) to provide fixation with the same solidity were measured using the developing material M and the developing material P11, the latter containing no cupric oxide (CuO). The results were that a temperature lower by about 10° C. was good for the developing material M. Compared with cases where other pigments were used, the fixing temperature for the developing material M was 5–10° C. lower to achieve the same fixation. Thus, the present invention proves to provide excellent fixation.

We claim:

1. In a toner for developing electrostatic latent images in an image forming machine by thermal fixation when a toner carrying substrate is passed between a pair of heated rollers, which toner comprises a high viscosity thermoplastic resin capable of forming an image by thermal fixation selected from the group consisting of styrene-acrylic copolymer resins, polyester resins, methacrylic resins and derivatives thereof and a black coloring material as main components, the improvement wherein said black coloring material consisting essentially of cupric oxide of 0.5–10μ average diameter in amounts of 1–30 weight parts relative to 100 weight parts of said thermoplastic resin, and carbon black being present in a weight ratio of 1/15–1 relative to said cupric oxide.

2. A toner according to claim 1 which also contains a chromium complex solvent dye or a nigrosine solvent dye in an amount sufficient to regulate the electric charges.

3. A toner according to claim 1 wherein said black coloring material further comprises carbon black contained in 1/30–1 weight ratio to said inorganic black pigment.

4. A toner according to claim 3 wherein said carbon black is contained in 1/15–1 weight ratio to said inorganic black pigment.

* * * * *

UNITED STATES PATENT AND TRADEMARK OFFICE

CERTIFICATE OF CORRECTION

PATENT NO. : 4,990,427

DATED : February 5, 1991

INVENTOR(S) : Toshitaro Kohri, et al

It is certified that error appears in the above-identified patent and that said Letters Patent is hereby corrected as shown below:

On title page "4 Claims, No Drawings" should read --3 Claims, No Drawings--.

UNITED STATES PATENT AND TRADEMARK OFFICE

CERTIFICATE OF CORRECTION

PATENT NO. : 4,990,427

DATED : February 5, 1991

INVENTOR(S) : Toshitaro KOHRI, et al.

It is certified that error appears in the above-identified patent and that said Letters Patent is hereby corrected as shown below:

Kindly amend the claims in column 10 of the patent as follows:

Cancel Claims 3 and 4 and substitute the following claim therefor:

3. In a toner for developing electrostatic images by thermal fixation in an image forming machine when a toner carrying substrate is passed between a pair of heating rollers, which toner comprises a high viscosity thermoplastic resin capable of forming an image by thermal fixation selected from the group consisting of styrene-acrylic copolymer resins, polyester resins, methacrylic resins and derivatives thereof and a black coloring material as the main components, the improvement wherein said black coloring material consists essentially of cupric oxide having a particle size of 0.5-10 um in diameter; and wherein said cupric oxide is present in an amount of 1-30 parts relative to 100 weight parts of said thermoplastic resin and carbon black present in a weight ratio of 1/30-1, relative to the cupric oxide.

Signed and Sealed this

Twenty-second Day of December, 1992

*Attest:*

DOUGLAS B. COMER

*Attesting Officer* *Acting Commissioner of Patents and Trademarks*